US009594330B1

(12) United States Patent
Shinozaki et al.

(10) Patent No.: US 9,594,330 B1
(45) Date of Patent: Mar. 14, 2017

(54) DETACHABLE BODY AND IMAGE FORMING APPARATUS

(71) Applicant: FUJI XEROX CO., LTD., Tokyo (JP)

(72) Inventors: Seigo Shinozaki, Kanagawa (JP); Keisuke Kubo, Kanagawa (JP); Makoto Kanno, Kanagawa (JP); Shota Oba, Kanagawa (JP); Norihiro Tamazawa, Kanagawa (JP); Ayumi Noguchi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/990,220

(22) Filed: Jan. 7, 2016

(30) Foreign Application Priority Data

Sep. 28, 2015 (JP) ..... 2015-189728

(51) Int. Cl.
*G03G 15/08* (2006.01)

(52) U.S. Cl.
CPC ..... *G03G 15/0881* (2013.01)

(58) Field of Classification Search
CPC ..... G03G 15/0881; G03G 15/0886; G03G 2215/0692
USPC ..... 399/106
See application file for complete search history.

(56) References Cited

U.S. PATENT DOCUMENTS

| | | | | |
|---|---|---|---|---|
| 6,292,644 | B1 * | 9/2001 | Goto | G03G 15/0855 222/167 |
| 2009/0238608 | A1 * | 9/2009 | Murase | G03G 15/0868 399/262 |
| 2013/0243491 | A1 | 9/2013 | Nodera et al. | |
| 2014/0029973 | A1 | 1/2014 | Terazawa et al. | |
| 2014/0050507 | A1 | 2/2014 | Hamada et al. | |

FOREIGN PATENT DOCUMENTS

| | | | |
|---|---|---|---|
| JP | 2012-230184 | A | 11/2012 |
| JP | 2013-218276 | A | 10/2013 |
| JP | 2014-038243 | A | 2/2014 |

* cited by examiner

*Primary Examiner* — Sandra Brase
(74) *Attorney, Agent, or Firm* — Oliff PLC

(57) ABSTRACT

A detachable body includes an opening portion, an opening and closing member, a sealing member, a sealing member, and a protrusion portion. The opening and closing member is movable between an open position and a closed position. The opening and closing member includes a facing portion that faces the opening portion with a gap when the opening and closing member is located at the closed position. When the opening and closing member is moved to the open position, the sealing member has a thickness that is thicker than a gap between the opening portion and the facing portion. When the opening and closing member is moved to the closed position, the sealing member elastically deforms to seal the opening portion. The protrusion portion protrudes from one of a frame portion around the opening portion and the facing portion toward the other.

6 Claims, 10 Drawing Sheets

DETACHABLE BODY AND IMAGE FORMING APPARATUS

CROSS-REFERENCE TO RELATED APPLICATIONS

This application is based on and claims priority under 35 USC 119 from Japanese Patent Application No. 2015-189728 filed Sep. 28, 2015.

BACKGROUND

Technical Field

Exemplary embodiments of the invention relate to a detachable body and an image forming apparatus.

SUMMARY

According to an aspect of the invention, a detachable body is supported to be detachable from an image forming apparatus main body. The detachable body includes an opening portion, an opening and closing member, a sealing member, a sealing member, and a first protrusion portion. The opening portion connects an inside and an outside of the detachable body. The opening and closing member is movable between an open position and a closed position. When the detachable body is mounted on the image forming apparatus main body, the opening and closing member is located at the open position to open the opening portion. When the detachable body is detached from the image forming apparatus main body, the opening and closing member is located at the closed position to close the opening portion. The opening and closing member includes a facing portion that faces the opening portion with a gap when the opening and closing member is located at the closed position. The sealing member is supported by the facing portion. When the opening and closing member is moved to the open position, the sealing member has a thickness that is thicker than a gap between the opening portion and the facing portion. When the opening and closing member is moved to the closed position, the sealing member elastically deforms to seal the opening portion. The first protrusion portion protrudes from one of a frame portion around the opening portion and the facing portion toward the other of the frame portion and the facing portion. The first protrusion portion has a protrusion amount shorter than the gap between the opening portion and the facing portion.

BRIEF DESCRIPTION OF THE DRAWINGS

Exemplary embodiments of the present invention will be described in detail based on the following figures, wherein:

FIG. 8A is a view that is viewed from obliquely above, and FIG. 8B is a view that is viewed from obliquely below;

DETAILED DESCRIPTION

Figure 1:
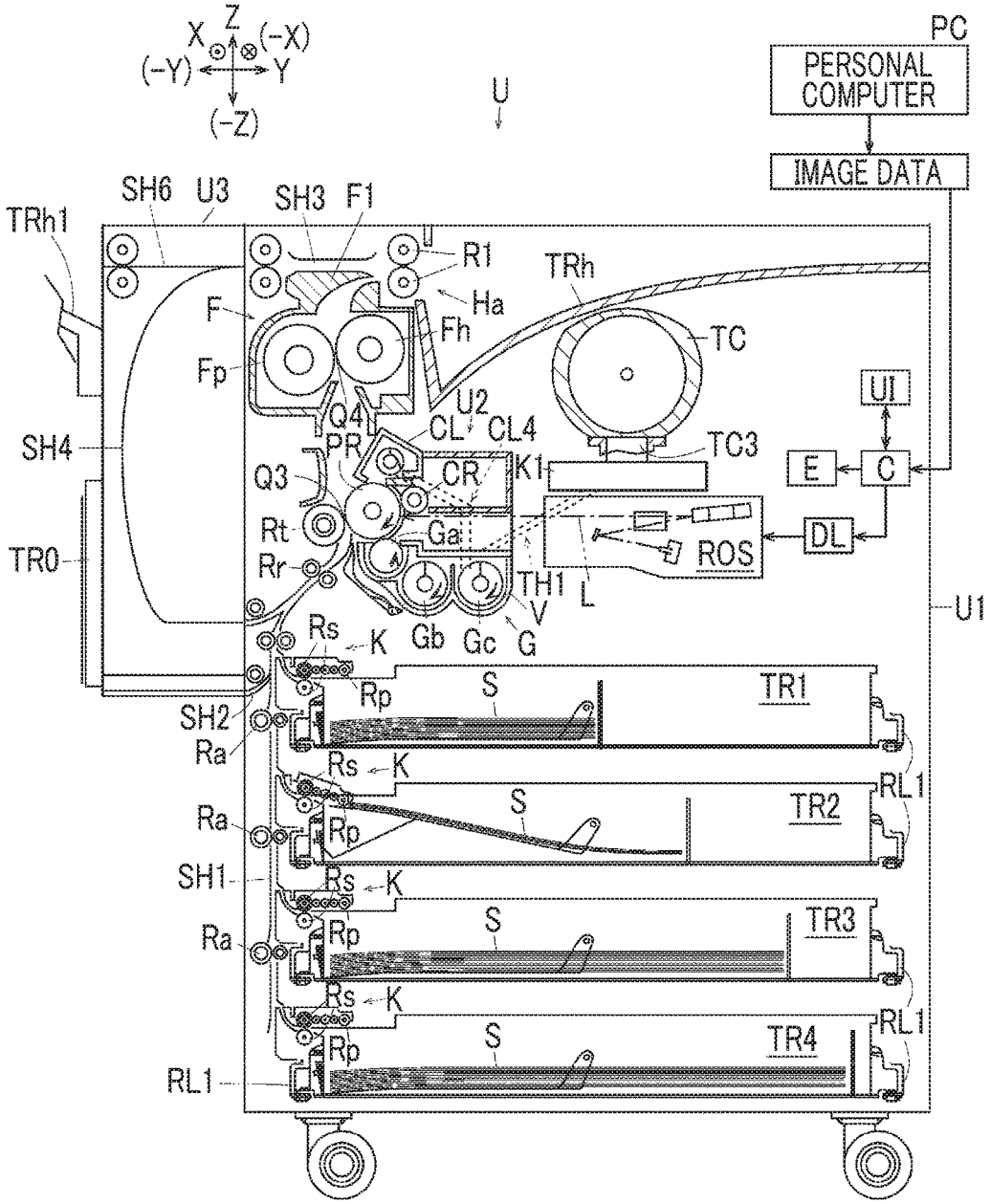
FIG. 1 is an explanatory view of an entire image forming apparatus of Example 1.

Next, a specific example (hereinafter, described as an example) of an exemplary embodiment of the invention will be described with reference to the drawings. It should be noted that the invention is not limited to the following example.

Moreover, for the sake of easily understanding the following description, in the drawings, a forward and backward direction is referred to as an X-axis direction, a rightward and leftward direction is referred to as a Y-axis direction, and an up and down direction is referred to as a Z-axis direction. Directions or sides indicated by arrows of X, −X, Y, −Y, Z, and −Z are respectively referred to as forward, backward, right, left, upper, and lower, or a front side, a back side, a right side, a left side, an upper side, and a lower side.

In addition, "•" that is described in "O" is means an arrow directed from a rear surface to a front surface of a paper surface and "x" that is described in "O" is means an arrow directed from the front surface to the rear surface of a paper surface.

Moreover, in the description using the following drawings, for the sake of easy understanding, illustration of members other than those necessary for description will appropriately be omitted.

Example 1

FIG. 1 is an entire explanatory view of an image forming apparatus of Example 1.

In FIG. 1, a printer U, as an example of an image forming apparatus of Example 1, has a printer main body U1 as an example of an apparatus main body. A first exit tray TRh, as an example of a first medium exit portion, is provided on an upper surface of the printer main body U1. An operation section UI is provided on a right upper surface of the printer main body U1. The operation section UI has a display section (not illustrated) and the like. The operation section UI is configured such that a user is able to perform an input operation.

A host computer, as an example of a transmitting device of image information, is illustrated in the printer U of Example and specifically, a personal computer is electrically connected to the printer U.

The printer U has a controller C as an example of a control section. The controller C is able to receive electric signals such as image information and control signals transmitted from a personal computer PC. In addition, the controller C is configured to be able to output the control signals to the operation section UI or an electric circuit E. Furthermore, the controller C is electrically connected to a writing circuit DL.

The writing circuit DL outputs a driving signal to an exposure device ROS as an example of a writing device in compliance with input information. The exposure device ROS is configured to be able to output a laser beam. L as an example of a writing light in compliance with the input signal.

Figure 2:
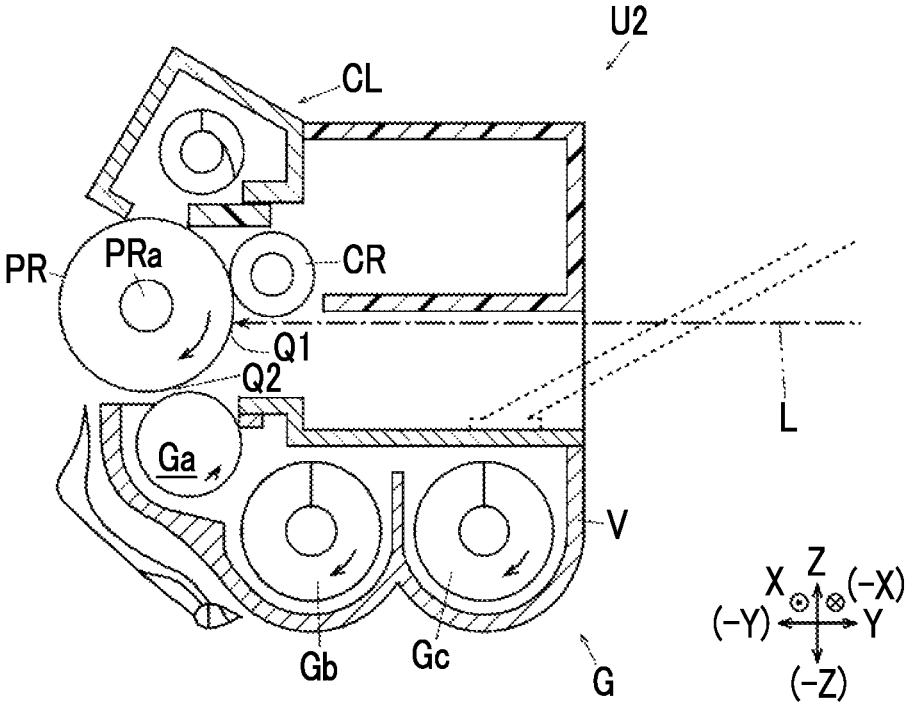
FIG. 2 is an enlarged view of a part of a toner image forming device portion of FIG. 1.

FIG. 2 is an enlarged view of a part of a toner image forming device portion of FIG. 1.

In FIGS. 1 and 2, a photoconductor PR, as an example of an image carrier, is disposed on a left side of the exposure device ROS. The photoconductor PR of Example 1 is rotatably supported about a rotational shaft PRa in an arrow direction. The photoconductor PR is irradiated with the laser beam L in a writing region Q1.

A charging roll CR as a charging member, a developing device G, and a photoconductor cleaner CL, as an example of a cleaner for the image carrier, are disposed in the periphery of the photoconductor PR in a rotational direction of the photoconductor PR.

Moreover, the photoconductor PR, the charging roll CR, the developing device G, and the photoconductor cleaner CL are formed to be an integrally detachable unit in the printer U of Example 1. That is, the photoconductor PR, the charging roll CR, the developing device G, and the photoconductor cleaner CL are configured to be detachable from the printer main body U1 as a process unit U2.

A charged voltage is applied from the electric circuit E to the charging roll CR.

The developing device G has a developing container V accommodating toner as an example of the developer on an inside thereof. A developing roll Ga, as an example of a holding member of the developer, is rotatably supported on an inside of the developing container V. The developing roll Ga is disposed to face the photoconductor PR in a developing region Q2.

In addition, a developing voltage is applied from the electric circuit E to the developing roll Ga. In addition, augers Gb and Gc, as an example of a transport member of the developer, are rotatably supplied on the inside of the developing container V.

A toner image forming apparatus that forms the toner image on the photoconductor PR is a configuration of the photoconductor PR, the charging roll CR, the exposure device ROS, the developing device G, and the like.

One end of a replenishing path of a toner replenishing device TH1, as an example of a replenishing device of the developer that is fixedly supported by the printer U, is connected to the developing container V. The other end of the replenishing path of the toner replenishing device TH1 is connected to a toner cartridge TC as an example of the accommodation container of the developer.

The toner cartridge TC is detachably configured by inserting and removing in the forward and backward direction with respect to the printer U.

In FIG. 1, plural sheet feeding trays TR1 to TR4, as an example of a medium accommodation portion, are provided on a lower portion of the printer U. The plural sheet feeding trays TR1 to TR4 accommodate recording sheets S as an example of the medium.

In FIG. 1, rails RL1, as an example of a guiding member of the container, are disposed on both right and left sides of each of the sheet feeding trays TR1 to TR4. The rails RL1 support both the right and left end portions of the sheet feeding trays TR1 to TR4 to be movable. Thus, each of the sheet feeding trays TR1 to TR4 are supported by a right and left pair of the rails RL1 to be able to enter and leave the printer U in the forward and backward direction.

In FIG. 1, a sheet feeding device K is disposed in a left upper portion of each of the sheet feeding trays TR1 to TR4. The sheet feeding device K has a pickup roll Rp as an example of a removal member of the medium. A separation roll Rs, as an example of a separation member, is disposed on the left side of the pickup roll Rp. The separation roll Rs is configured with a feed roll as an example of the transparent member of the medium and a retard roll as an example of a separation member of the medium.

A sheet feeding path SH1, as an example of the transporting path of the medium, is disposed on the left side of the sheet feeding device K. The sheet feeding path SH1 extends upward. Plural transport rolls Ra, as an example of the transport member of the medium, are disposed in the sheet feeding path SH1. A registration roll Rr, as an example of an adjustment member of a transport time of the medium, is disposed in an upper end that is a downstream end of the sheet feeding path SH1.

In addition, a manual feed tray TR0, as an example of a manual feed portion, is mounted on a left side portion of the printer U. A left end of a manual feed path SH2, as an example of a transporting path for manual feeding, is connected to a right portion of the manual feed tray TR0. The right end of the manual feed path SH2 is connected to the sheet feeding path SH1.

In FIG. 1, a transfer roll Rt, as an example of a transfer device, is disposed above the registration roll Rr. The transfer roll Rt faces and contacts with the photoconductor PR in a transfer region Q3. Thus, the transfer roll Rt of Example 1 rotates in compliance with a rotation of the photoconductor PR. A transfer voltage is applied from the electric circuit E to the transfer roll Rt.

The photoconductor cleaner CL is disposed on a downstream side of the transfer roll Rt in a rotational direction of the photoconductor PR. A recovery path CL4, as an example of a transporting path of the developer, is supported by the photoconductor cleaner CL. The recovery path CL4 extends from the photoconductor cleaner CL to the developing device G.

In FIG. 1, a fixing device F is supported on an upper side of the transfer roll Rt. The fixing device F has a heating roll Fh as an example of a heating and fixing member, and a pressure roll Fp as an example of a pressing and fixing member. The heating roll Fh contacts with the pressure roll Fp in a fixing region Q4. The heating roll Fh is rotated by a driving force that is transmitted from a driving source (not illustrated). In addition, power for heating a heater (not illustrated) is supplied from the electric circuit E to the heating roll Fh.

An image recording section U2+Rt+F for recording the image on the sheet S is configured with the process unit U2, the transfer roll Rt, and the fixing device F as an example of a toner image forming device.

A sheet guide F1, as an example of a guiding portion of the medium, is formed in an upper portion of the fixing device F. An ejection roll R1, as an example of an exit member of the medium, is disposed on a right side of the sheet guide F1. An exit port Ha of the medium is formed on the right side of the ejection roll R1. The first exit tray TRh is disposed below the exit port Ha of the medium.

In FIG. 1, a connection path SH3, as an example of the transporting path of the medium, is disposed on an upper side of the fixing device F and a left side of the ejection roll R1. The connection path SH3 extends from the exit port Ha of the medium on the left side.

An inversion unit U3, as an example of an inversion device of the medium, is supported on an upper side of the manual feed tray TR0 in a left side surface of the printer main body U1. An inversion path SH4, as an example of the transporting path of the medium, is formed on an inside of the inversion unit U3. An upper end of the inversion path SH4 is connected to a left end of the connection path SH3.

A lower end of the inversion path SH4 joins the sheet feeding path SH1 on an upstream side of the registration roll Rr.

In addition, a second exit path SH6, as an example of the transporting path of the medium, is formed in an upper portion of the inversion unit U3. A right end of the second exit path SH6 is connected to the connection path SH3 and is branched from the inversion path SH4. A left end of the second exit path SH6 extends to a left side surface of the inversion unit U3. A face up tray TRh1, as an example of a second exit portion, is supported on the left side surface of the inversion unit U3. Thus, the sheet S passing through the second exit path SH6 is configured to be able to exit to the face up tray TRh1.

(Function of Image Forming Apparatus)

In the printer U of Example 1 including the above-described configuration, image information transmitted from the personal computer PC is input into the controller C. The controller C converts the input image information into information for latent image formation at timing that is set in advance and outputs the information to the writing circuit DL. The exposure device ROS outputs the laser beam L based on signals received by the writing circuit DL. Moreover, the controller C controls operations of the operation section UI, the writing circuit DL, the electric circuit E, and the like.

In FIGS. 1 and 2, the surface of the photoconductor PR is charged by the charging roll CR to which the charged voltage is applied. An electrostatic latent image is formed on the surface of the photoconductor PR that is charged by the charging roll CR by exposing and scanning the surface of the photoconductor PR with the laser beam L of the exposure device ROS in the writing region Q1. The surface of the photoconductor PR on which the electrostatic latent image is formed passes through the developing region Q2 and the transfer region Q3 sequentially.

In the developing region Q2, the developing roll Ga faces the photoconductor PR. The developing roll Ga rotates to hold the developer on the inside of the developing container V on the surface thereof. Thus, the electrostatic latent image on the surface of the photoconductor PR is developed to the toner image as an example of a visible image by the toner image that is held on the surface of the developing roll Ga. The developer on the inside of the developing container V is circulated while being agitated by the augers Gb and Gc.

If the developer on the inside of the developing container V is consumed in compliance with the development by the developing roll Ga, the developer is replenished from the toner cartridge TC. That is, toner inside the toner cartridge TC is transported to an exit port TC3 depending on a consumption amount of the developer. Toner that exits from the exit port TC3 is transported to the developing container V by a replenishing transport member (not illustrated) within the replenishing path of the toner replenishing device TH1.

Each of the sheet feeding trays TR1 to TR4 accommodates the sheet S on which the image is recorded. The sheet S accommodated in each of the sheet feeding trays TR1 to TR4 is removed by the pickup roll Rp of the sheet feeding device K. The sheets S that are removed by the pickup roll Rp are separated by the separation roll Rs one by one. The sheet S that is separated by the separation roll Rs is fed to the sheet feeding path SH1. The sheet S of the sheet feeding path SH1 is transported to the registration roll Rr by the transport rolls Ra.

Moreover, the sheet S that is fed from the manual feed tray TR0 is transported to the registration roll Rr through the manual feed path SH2. The sheet S that is transported to the registration roll Rr is transported to the transfer region Q3 by the registration roll Rr in compliance with timing when the toner image on the surface of the photoconductor PR is moved to the transfer region Q3.

In the transfer region Q3, the toner image of the surface of the photoconductor PR is transferred to the sheet S passing through the transfer region Q3 by the transfer roll Rt to which the transfer voltage is applied.

In FIG. 2, in the photoconductor PR after passing through the transfer region Q3, toner adhered to the surface thereof is removed and cleaned by the photoconductor cleaner CL. Toner that is removed by the photoconductor cleaner CL is returned to the inside of the developing container V through the recovery path CL4. That is, the developer recovered by the photoconductor cleaner CL is reused in the developing device G.

The photoconductor PR of which the surface is cleaned by the photoconductor cleaner CL is recharged by the charging roll CR.

The sheet S to which the toner image is transferred in the transfer region Q3 is transported to the fixing region Q4 of the fixing device F in a state where the toner image is not fixed.

In the fixing region Q4, the toner image is heated and fixed to the sheet S by pinching the sheet S between the heating roll Fh and the pressure roll Fp.

The sheet S to which the toner image is fixed by the fixing device F is transported to the ejection roll R1 by being guided by the sheet guide F1. If the sheet S exits to the first exit tray TRh, the sheet S delivered to the ejection roll R1 exits from the exit port Ha of the medium to the first exit tray TRh.

During double-side printing, the ejection roll R1 reversely rotates in a state where the sheet S on one surface of which an image is recorded and a trailing end of which in the transport direction passes through the sheet guide F1. Thus, the sheet S is transported to the inversion path SH4 through the connection path SH3. The sheet S that is transported to the inversion path SH4 is transported to the registration roll Rr in a state where a front and rear surfaces thereof are reversed. Thus, the sheet S is delivered again from the registration roll Rr to the transfer region Q3 and an image of a second surface is recorded.

If the sheet S exits to the face up tray TRh1, the sheet S that is transported on the connection path SH3 by the reverse rotation of the ejection roll R1 enters the second exit path SH6. Then, the sheet S that is transported to the second exit path SH6 exits to the face up tray TRh1.

(Description of Toner Cartridge)

Figure 3:
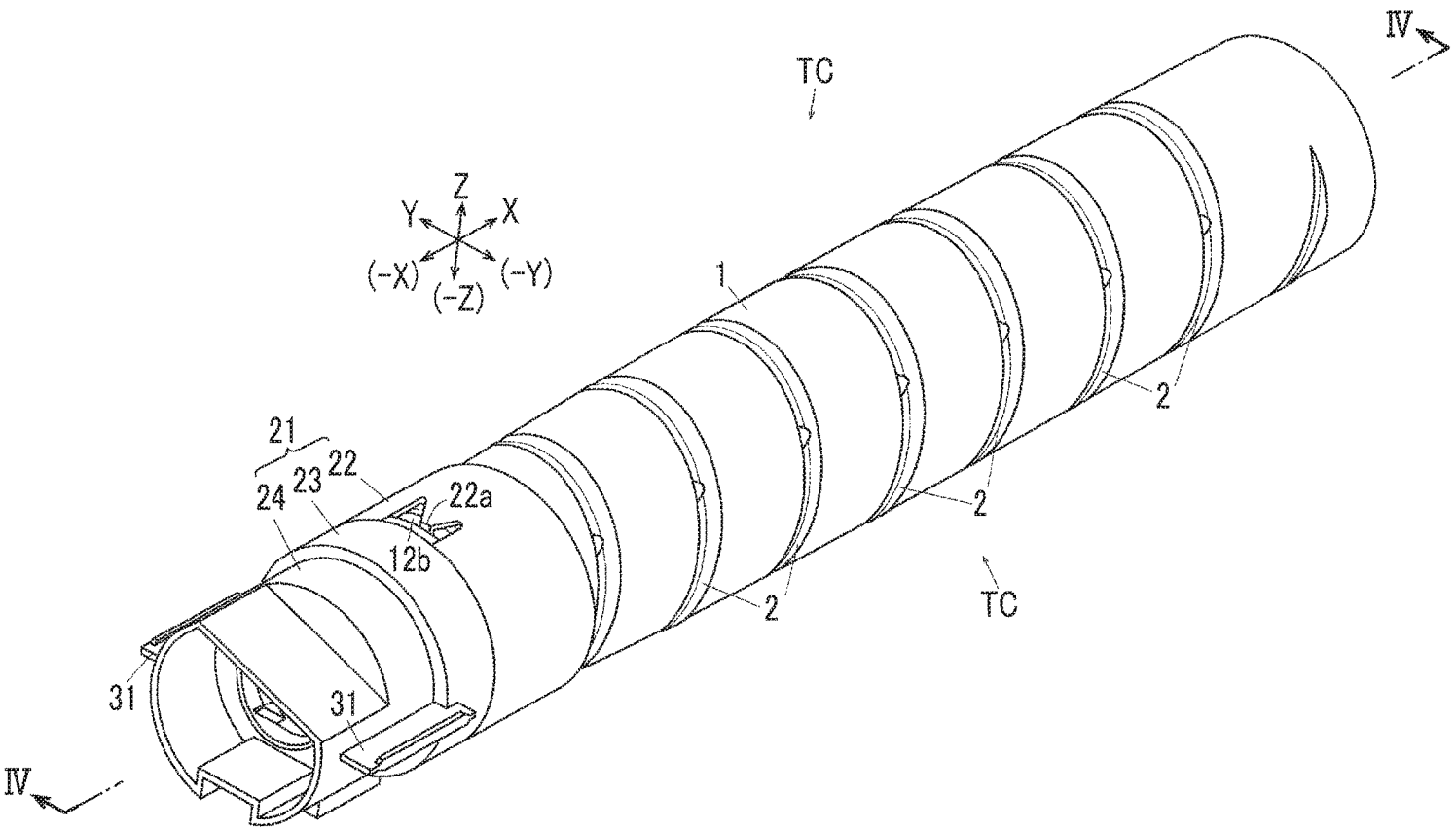
FIG. 3 is a perspective view of a toner cartridge of Example 1.

FIG. 3 is a perspective view of the toner cartridge of Example 1.

Figure 4:
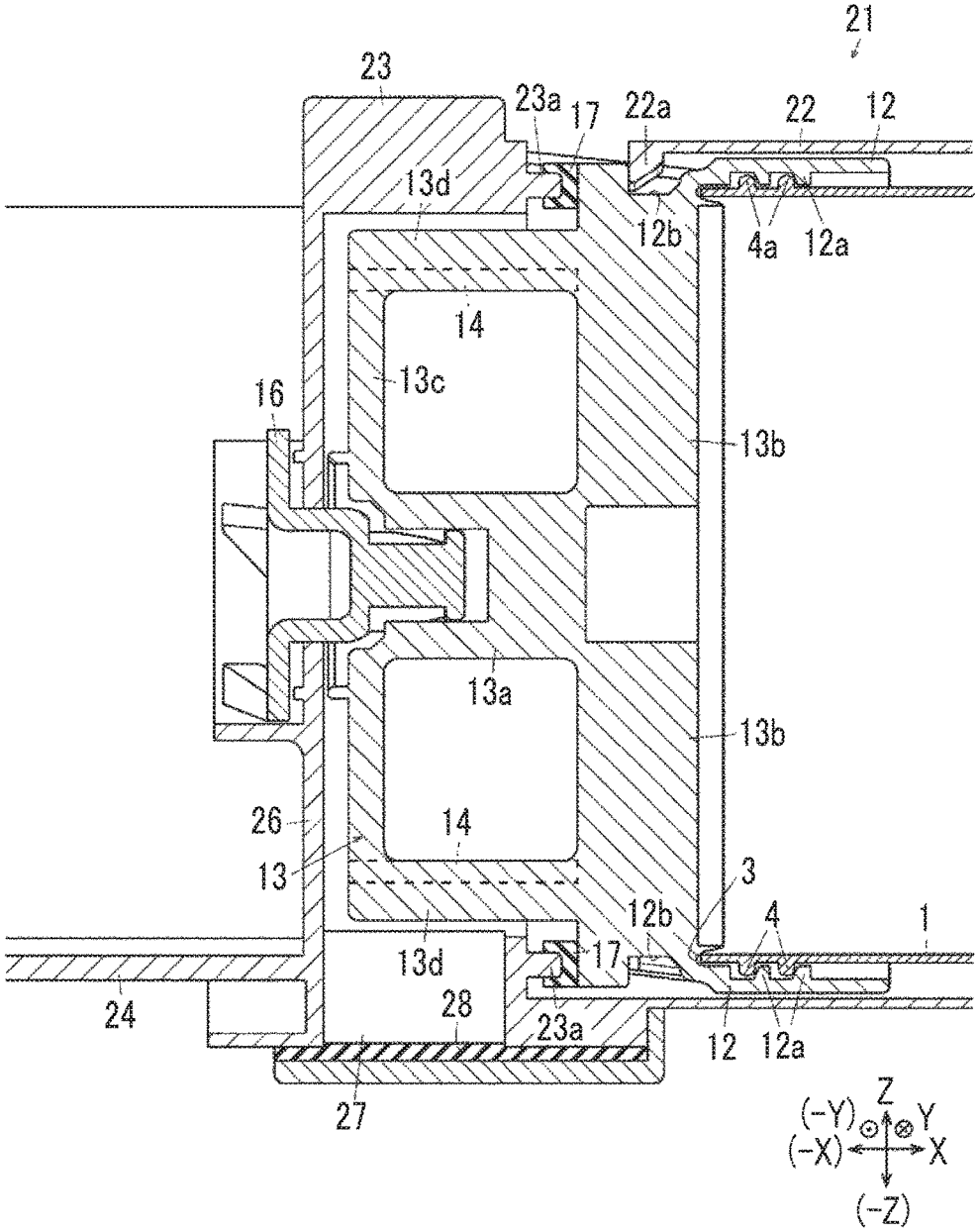
FIG. 4 is a sectional view taken along line IV-IV of FIG. 3.

FIG. 4 is a sectional view that is taken along line IV-IV of FIG. 3.

In FIGS. 3 and 4, the toner cartridge TC, as an example of the detachable body, has a bottle 1 as an example of the accommodation portion. The bottle 1 is formed in a cylindrical shape extending in the forward and backward direction and is configured to accommodate the developer on an inside thereof. A spiral groove portion 2, as an example of the transport portion, is formed on a wall surface of the bottle 1. In FIGS. 3 and 4, an opening 3 is formed at a rear end of the bottle 1. A screw portion 4, as an example of a fastening portion, is formed in a position on a front side of the opening 3 on an outer surface of the bottle 1.

Figure 5:
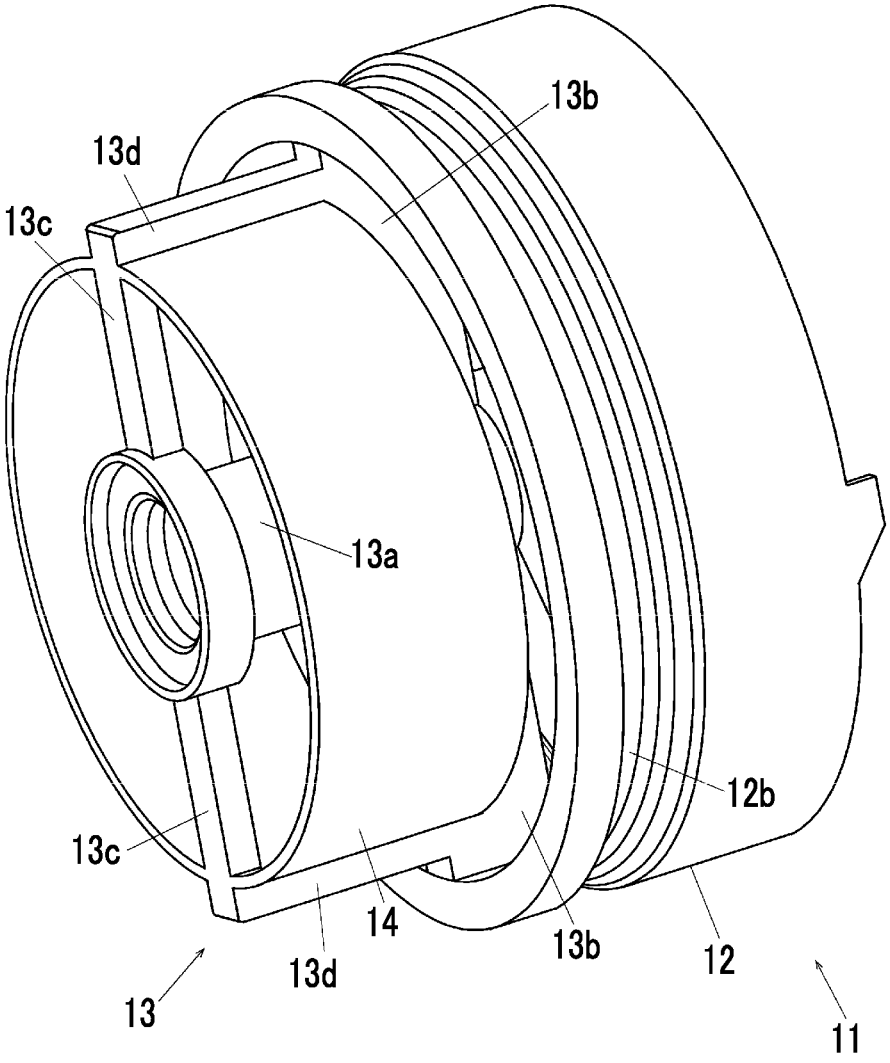
FIG. 5 is an explanatory view of a fin member of Example 1.

FIG. 5 is an explanatory view of a fin member of Example 1.

In FIGS. 3 to 5, a fin member 11, as an example of a break-down member, is disposed on a rear side of the bottle 1. The fin member 11 has a cylindrical portion 12 on a front side and a fin main body 13 on a rear side. A screw portion 12*a*, as an example of the fastening portion, is formed on an inner circumferential surface of the cylindrical portion 12. The screw portion 12*a* is formed corresponding to the screw portion 4. Then, the screw portion 12*a* engages with the screw portion 4 and the fin member 11 is fastened to the bottle 1. Thus, rotation portions 1 and 11 of Example 1 are configured with the fin member 11 and the bottle 1.

In addition, a ring-shaped concave groove 12*b* is formed on an outer periphery of a rear portion of the cylindrical portion 12.

The fin main body 13 has a shaft portion 13*a* extending in the forward and backward direction. A support arm 13*b*, as an example of a break-down portion and as an example of a portion to be supported extending on the outside in a radial direction, is formed at a front end of the shaft portion 13*a*. An outer end of the support arm 13*b* is connected to an inner peripheral surface of the cylindrical portion 12.

A first break-down portion 13*c* extending to the outside in the radial direction is formed in a rear portion of the shaft portion 13*a*. A second break-down portion 13*d* extending in the forward and backward direction is formed between the outer end of the first break-down portion 13*c* in the radial direction and the support arm 13*b*.

A cylindrical wall member 14 is integrally formed on an inside of the second break-down portion 13*d*. In FIG. 4, a gap is formed between the wall member 14 of Example 1 and an upper end of an exit path 27 described below. In Example 1, the gap is set to be 5 mm and an amount per unit time of the developer that is transported and the like may be arbitrary changed in compliance with a design or use.

A coupling 16, as an example of a driven transmission member, is supported in the rear end of the shaft portion 13*a*. If the toner cartridge TC is mounted on the printer main body U1, the coupling 16 engages with a coupling supported by the printer main body U1 and a driving force is transmitted to the coupling.

In FIGS. 4 and 5, a toner seal 17, as an example of a leakage preventing member, is supported by a rear end surface of the cylindrical portion 12. The toner seal 17 is formed in an annular shape, a so-called ring shape along the rear end surface of the cylindrical portion 12. Moreover, the toner seal 17 is formed of an arbitrary material capable of preventing the leakage of the developer and, for example, a foam member such as sponge may be used.

A flange portion 21, as an example of an exit portion, is supported by a rear side of the fin member 11. The flange portion 21 is configured in a cylindrical shape. The flange portion 21 has an intermediate diameter portion 22 of a front portion, a large diameter portion 23 of a center in the forward and backward direction, and a small diameter portion 24 of a rear portion.

The intermediate diameter portion 22 has an inner diameter to cover an outer periphery of the rear portion of the rotation portions 1 and 11. A claw portion 22*a*, as an example of the connection portion, is formed in the intermediate diameter portion 22. The claw portion 22*a* is disposed on a position corresponding to the ring-shaped concave groove 12*b* and extends on an inside in the radial direction. The claw portion 22*a* contacts with the concave groove 12*b* and regulates that the rotation portions 1 and 11 moves forward with respect to the flange portion 21. That is, the claw portion 22*a* connects the rotation portions 1 and 11, and the flange portion 21. Moreover, only one claw portion 22*a* is illustrated in FIG. 3, but the plural claw portions 22*a* are disposed in a peripheral direction of the cylindrical intermediate diameter portion 22.

A ring-shaped convex portion 23*a*, as an example of an interference portion, is formed in a front end of the large diameter portion 23. Thus, the convex portion 23*a* is supported in a state of compressing the toner seal 17 so as to interfere with the toner seal 17 if the flange portion 21 is connected to the rotation portions 1 and 11.

A plate-shaped wall portion 26 extending in the up and down direction and in the rightward and leftward direction is formed in a boundary portion between the large diameter portion 23 and the small diameter portion 24. The coupling 16 is rotatably supported by the wall portion 26 with passing through the wall portion 26.

The exit path 27 extending on a lower side is formed below the wall portion 26. An exit port 28, as an example of an opening portion, is formed in a lower end of the exit path 27.

In FIG. 3, an insertion guide 31, as an example of a portion to be guided, is formed on an outer peripheral surface of the small diameter portion 24. If the toner cartridge TC is mounted, the insertion guide 31 is guided to a guide portion (not illustrated) provided in the printer main body U1 as an example of a main body of the image forming apparatus.

(Description of Toner Exit Port and Shutter)

Figure 6:
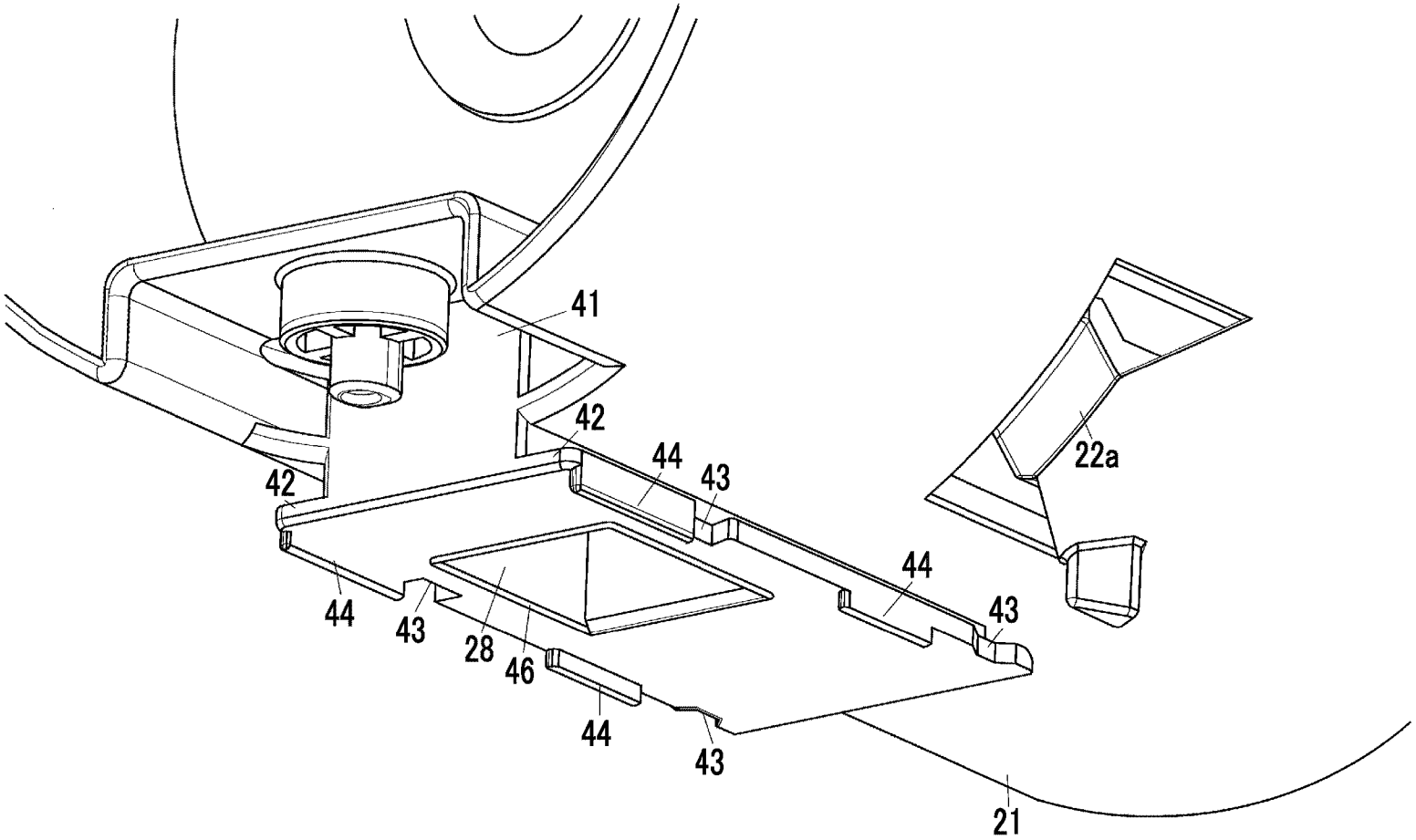
FIG. 6 is an enlarged view of a part an exit port of the toner cartridge of Example 1.

FIG. 6 is an enlarged view of a part of the exit port of the toner cartridge of Example 1.

In FIG. 6, a flow-out portion 41 through which the developer flows out is formed in a bottom portion of the flange portion 21 of the toner cartridge of Example 1. The flow-out portion 41 is formed in a cylindrical shape extending on a lower side. The exit path 27 is formed on an inside of the flow-out portion 41 and the exit port 28 is formed in a lower end of the exit path 27.

A shutter guide 42, as an example of a frame portion and as an example of a guide portion, is provided in the lower end of the flow-out portion 41 of Example 1. The shutter guide 42 extends on an outside in the rightward and leftward direction, and is formed in a plate shape extending in the forward and backward direction. Shutter locks 43, as an example of a regulation portion, are formed in a pair of right and left shutter guides 42. The shutter locks 43 are formed in a recessed shape on an inside in the rightward and leftward direction in a front end portion and a rear portion of the shutter guide 42 in the forward and backward direction.

Spacer ribs 44, as an example of a first protrusion portion, are formed in both right and left ends of the shutter guide 42. The spacer ribs 44 are configured with protrusions extending on a lower side.

In addition, a small rib 46, as an example of a second protrusion portion, is formed in the flow-out portion 41 along an edge of the exit port 28. The small rib 46 is formed to be higher than the spacer rib 44, that is, a protrusion amount on the lower side is short.

Figure 7:
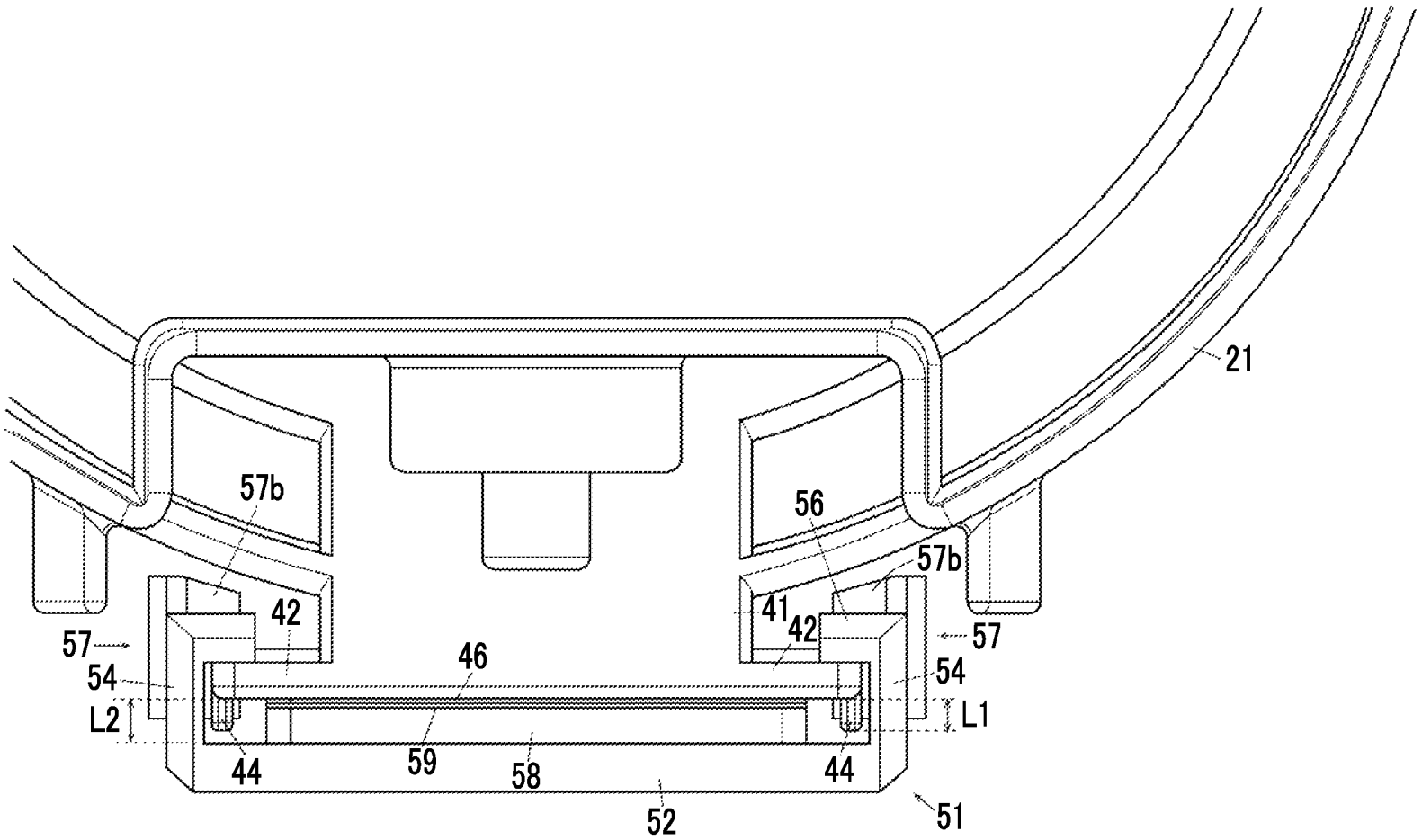
FIG. 7 is an enlarged view of a shutter portion of the exit port in the toner cartridge of Example 1.

FIG. 7 is an enlarged view of the shutter portion of the exit port in the toner cartridge of Example 1.

Figure 8A:
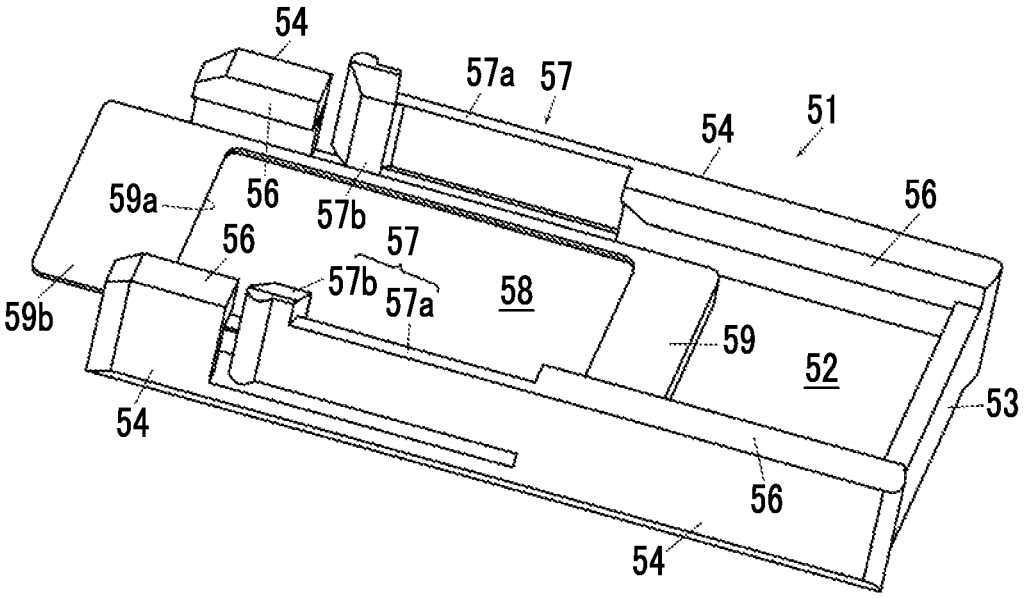
FIGS. 8A and 8B are perspective views of a shutter of Example 1.
Figure 8B:
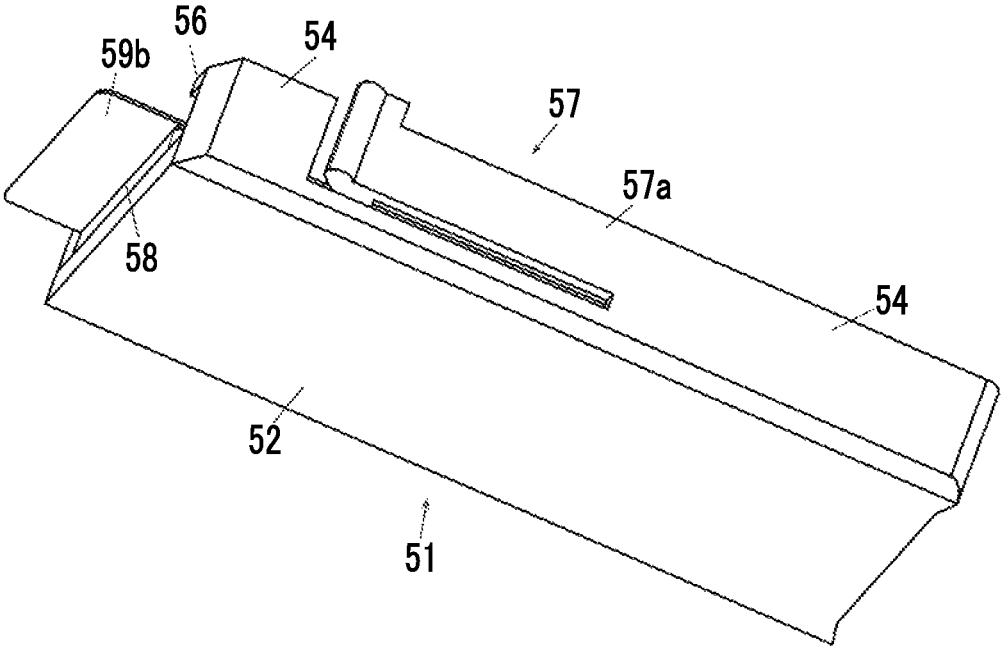

FIGS. 8A and 8B are perspective views of the shutter of Example 1, FIG. 8A is a view that is viewed from obliquely above, and FIG. 8B is a view that is viewed from obliquely below.

Figure 9:
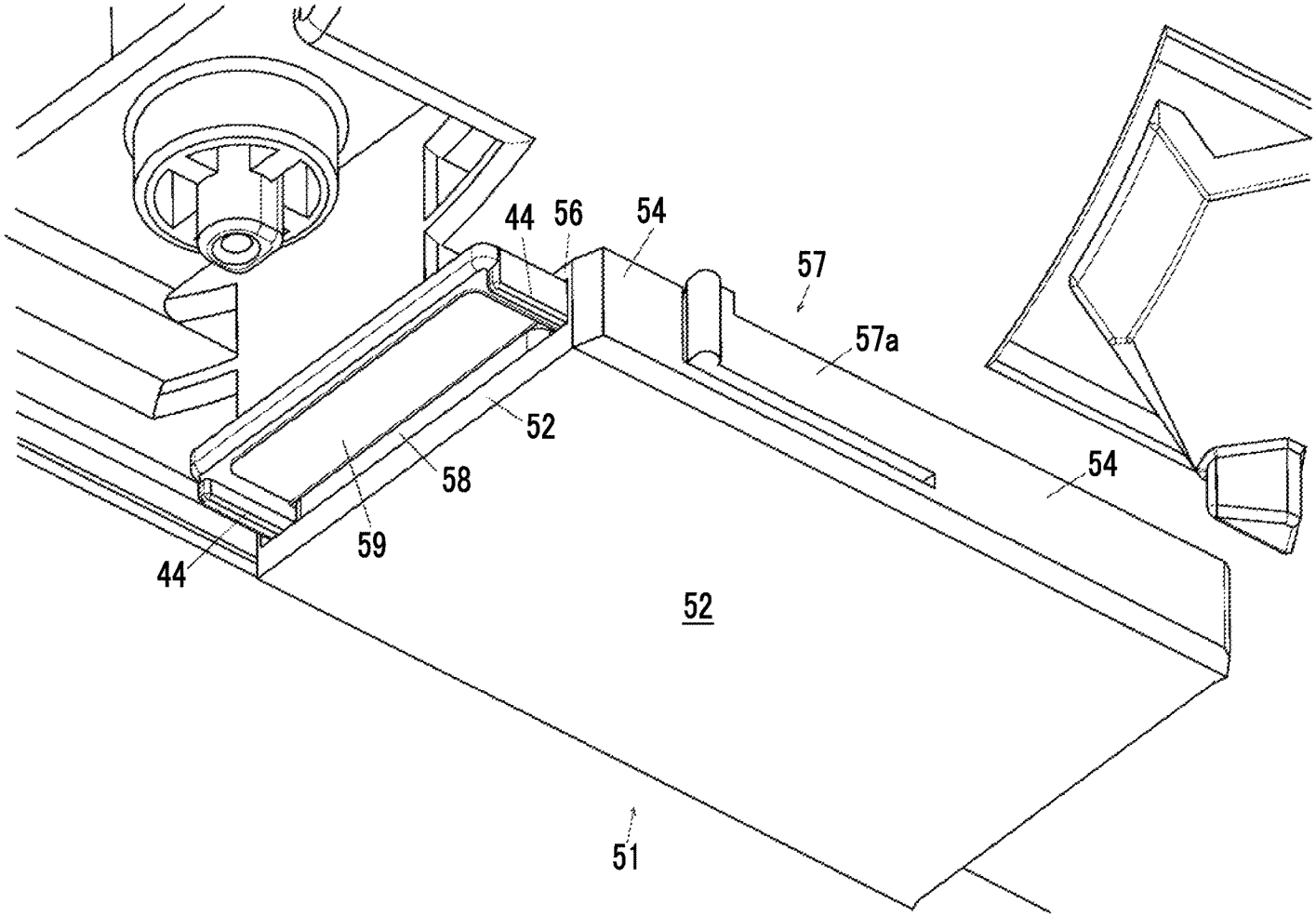
FIG. 9 is an explanatory view of a state where the shutter of Example 1 is moved to a closed position.

FIG. 9 is an explanatory view of a state where the shutter of Example 1 is moved to a closed position.

Figure 10:
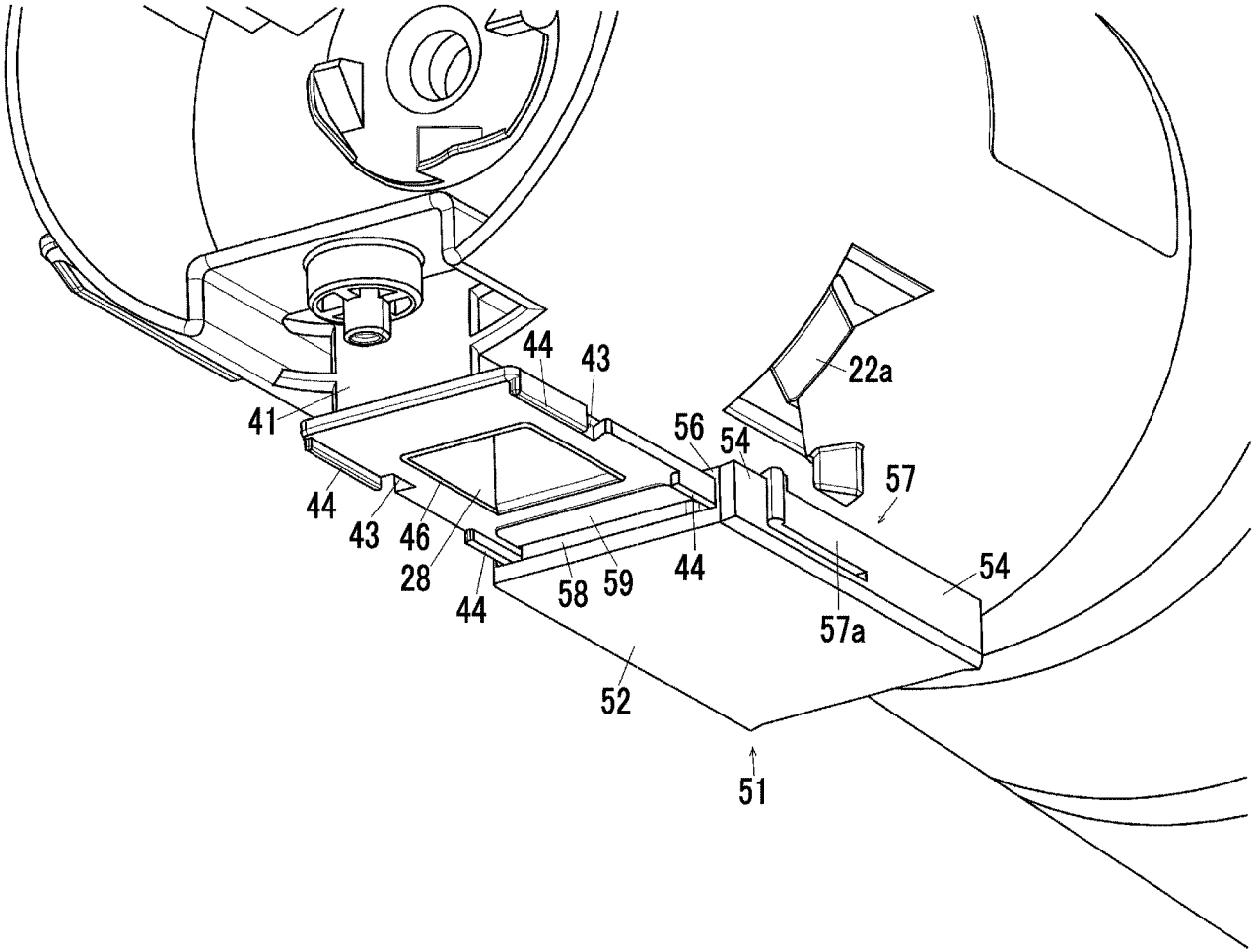
FIG. 10 is an explanatory view of a state where the shutter of Example 1 is moved to an open position.

FIG. 10 is an explanatory view of a state where shutter of Example 1 is moved to an open position.

In FIG. 7, a shutter 51, as an example of the opening and closing member, is supported by the flow-out portion 41 to be movable in the forward and backward direction. In FIGS. 7 to 10, the shutter 51 of Example 1 has a shutter main body 52 as an example of a facing portion. The shutter main body 52 is formed in a flat plate shape facing the exit port 28.

A front wall 53 is formed in a front end of the shutter main body 52.

A pair of side walls 54 are formed both right and left ends of the shutter main body 52. Guide rails 56, as an example of a portion to be guided, are formed in upper ends of the pair of side walls 54. The guide rails 56 extend inward in the rightward and leftward direction. Lower surfaces of the guide rails 56 are configured to be guided on an upper surface of the shutter guide 42 and the guide rails 56 are guided by the shutter guide 42. Thus, the shutter 51 is movably supported between the closed position illustrated in FIG. 9 and the open position illustrated in FIG. 10 in the forward and backward direction.

Lock arms 57, as an example of a portion to be regulated, are disposed in a center portion of each side wall 54 in the forward and backward direction. A pair of right and left lock arms 57 has plate spring portions 57*a* as an example of an elastic portion. The plate spring portion 57*a* is formed in a plate shape extending in the forward and backward direction, and is configured to be elastically deformed. A claw portion 57*b* is formed in a rear end of the plate spring portion 57*a*. The claw portion 57*b* protrudes inward in the rightward and leftward direction. The claw portions 57*b* are formed in a shape to fit the shutter locks 43.

In Example 1, if the shutter 51 is moved to the closed position, the claw portion 57*b* is fitted into the shutter lock 43 on the rear side and if the shutter 51 is moved to the open position, the claw portion 57*b* is set to be fitted into the shutter lock 43 on the front side.

In FIGS. 7 and 8, a seal 58, as an example of a sealing member, is supported by an upper surface of the shutter main body 52. The seal 58 is made of a material to be elastically deformed and may be made of a material such as rubber or sponge in compliance with a design or specification.

In addition, a scraping film 59, as an example of a scraping member, is supported by the upper surface of the seal 58. In the scraping film 59, an opening 59*a* is formed in a position corresponding to the exit port 28. That is, the seal 58 is exposed in a portion of the opening 59*a*. A rear end portion 59*b*, as an example of a scraping portion, extends on the outside further than a rear end of the shutter main body 52, that is, rearward. The scraping film 59 may be made of an arbitrary material in compliance with the design and specification, and, as an example, a PET film may be used.

In FIG. 7, in Example 1, a protrusion amount L1 of the spacer rib 44 is set to be shorter than a distance L2 between the exit port 28 and an upper surface of the shutter main body 52. In addition, in a state where the shutter 51 is moved to the open position, that is, the seal 58 is in a natural length state before being elastically deformed, the seal 58 is set to have a thickness thicker than the distance L2. Thus, if the shutter 51 is moved to the closed position, the seal 58 is deformed to a thickness corresponding to the scraping film 59 and the distance L2.

In FIG. 10, in Example 1, if the shutter 51 is moved to the closed position, the spacer ribs 44 on the rear side are disposed on the outside of the rear end portion 59*b* of the scraping film 59 in the rightward and leftward direction. Moreover, the protrusion amount L1 of the spacer rib 44 is set to be greater than the thickness of the scraping film 59.

(Operation of Example 1)

In the printer U of Example 1 including the above-described configuration, if the toner cartridge TC is mounted on the printer main body U1, the shutter 51 is moved to the open position. Thus, the exit port 28 is connected to a flow-in port (not illustrated) of the toner replenishing device TH1. Then, image formation is performed in the printer main body U1 and if the driving force is transmitted to the coupling 16 in compliance with the consumption of toner, the fin member 11 and the bottle 1 are rotated. If the bottle 1 is rotated, the developer is transported to the rear side along the spiral groove portion 2. Thus, in the toner cartridge TC of Example 1, a rotating transport member is not necessary on the inside of the bottle and it is possible to reduce manufacturing costs of the toner cartridge TC.

The developer that is transported to the rear side in compliance with the rotation of the bottle 1 is replenished in the toner replenishing device TH1 through the exit port 28. Moreover, the fin main body 13 is also rotated during rotation of the bottle 1, toner that agglomerates in the vicinity of the exit port 28 is broken down, and is loosened. Thus, it is possible to suppress the developer from agglomerating the vicinity of the exit port 28 and clogging up the exit port 28 as compared to the configuration that the fin main body 13 is not provided.

If the developer of the toner cartridge TC is empty, the toner cartridge TC is removed from the printer main body U1. In this case, the shutter 51 is moved to the closed position. Moreover, when the shutter 51 is moved from the open position to the closed position, the rear end portion 59*b* of the scraping film 59 passes through the lower surface of the exit port 28. Thus, if the developer approaching the toner replenishing device TH1 from the exit port 28 is present, the developer is scraped. Thus, it is possible to reduce occurrence of the developer leaking between the toner replenishing device TH1 and the shutter 51 when the shutter 51 moves to the closed position compared to a case where the scraping film 59 is not present. Particularly, in Example 1, the rear end of the scraping film 59 protrudes rearward more than the shutter 51 and adhesion of the developer on the rear end surface of the shutter 51 is reduced compared to a case where the rear end of the scraping film 59 does not protrude rearward.

In the toner cartridge TC that is removed from the printer main body U1 or in a new toner cartridge TC that replaces another one, the shutter 51 is moved to the closed position. Moreover, in Example 1, in the closed position, the claw portion 57*b* of the lock arm 57 is fitted into the shutter lock 43 and the shutter 51 is held in the closed position. Thus, when an operator handles the toner cartridge TC, movement of the shutter 51 is reduced even if the operator contacts with the shutter 51 or the shutter 51 contacts with a desk, a floor, or the like, compared to a case where the lock arm 57 or the shutter lock 43 is not provided. Thus, leakage of the developer by opening the shutter 51 is reduced.

In addition, in a state where the shutter 51 is moved to the closed position, the exit port 28 is closed and sealed in a state where the seal 58 is elastically deformed. Here, in a configuration of the related art in which the spacer rib 44 is not provided, if the operator drops the toner cartridge by mistake, the shutter hits the floor or the like, and then the shutter undergoes a large impact, the seal may be rapidly compressed. Then, the shutter may be moved in a direction in which the shutter is separated from the exit port by a reaction after rapid compression. In this case, even if the gap between the shutter main body and the exit port is to be returned to its original state, elastic restoration of the compressed seal by the reaction may not follow. If the elastic restoration of the seal does not follow the movement by the reaction of the shutter, a gap occurs between the seal and the exit port, and there is a concern that the developer is leaked.

On the other hand, in Example 1, the spacer rib 44 is provided and even if the shutter 51 undergoes a large impact and then the seal 58 is to be compressed rapidly, the spacer rib 44 contacts with the shutter main body 52. Thus, compression of the seal 58 is regulated to be (gap L2)–(protrusion amount L1 of the spacer rib 44). Thus, the rapid compression of the seal 58 or the movement of the shutter 51 by the reaction is reduced as compared to the configuration that the spacer rib 44 is not provided. Thus, leakage of the developer is reduced.

In Example 1, the spacer ribs 44 on the rear side are disposed on both right and left sides of the rear end portion 59*b* of the scraping film 59. For example, if the spacer ribs 44 are not provided on both right and left sides of the rear end portion 59*b*, the thin film like rear end portion 59*b* is in a state of exposing to the outside. Thus, there is a concern that the operator handling the toner cartridge TC contacts with the rear end portion 59*b* of the scraping film 59 or the rear end portion 59*b* is deformed by contacting with the desk and the like. If the rear end portion 59*b* is deformed, there is a concern that the ability to scrape the developer is lowered, and there is a concern that the developer is likely to leak. On the other hand, in Example 1, the spacer rib 44 also has a function of protecting the scraping film 59 and deformation or damage of the scraping film 59 is reduced as compared to the configuration that the spacer rib 44 is not provided.

In addition, in Example 1, the small rib 46 is provided in an edge of the exit port 28. Thus, a compression amount of the seal 58 is greater in the periphery of the exit port 28 than a portion that does not contact with the small rib 46. Thus, leakage of the developer is likely to be reduced in the vicinity of the exit port 28.

(Modification Example)

Above, it describes an example of the invention in detail, but exemplary embodiments of the invention is not limited to the example, and various modifications may be performed in the scope of the exemplary embodiments of the invention described in the claims. Modification examples (H01) to (H010) of the invention are given below.

(H01) In the above-described example, the printer as an example of the image forming apparatus is exemplified. However, the exemplary embodiment of the invention is not limited to the example. For example, it is possible to apply the exemplary embodiment of the invention to an image forming apparatus such as a copier or a FAX.

(H02) In the above-described example, the configuration that the flange portion 21 is disposed on the front side of the toner cartridge TC in the mounting direction, that is, on the back side of the printer main body U1 is exemplified. However, the exemplary embodiment of the invention is not limited to the configuration. For example, the configuration that the flange portion 21 and the like are disposed on the rear side in the mounting direction, that is, on the front side of the printer main body U1, may be provided.

(H03) In the above-described example, the toner cartridge that transports the developer by rotating the rotation portions 1 and 11 is exemplified. However, the exemplary embodiment of the invention is not limited to the configuration. For example, it is also possible to apply the exemplary embodiment of the invention to a toner cartridge that transports the developer by rotating a spiral transport member disposed on the inside of the bottle 1.

(H04) In the above-described example, the toner cartridge TC as an example of the detachable body is exemplified, but the configuration is not limited to the example. It is also possible to apply the exemplary embodiment of the invention to a detachable body that has a shutter or an opening and closing cover as an example of the opening and closing member that opens and closes the inside thereof to the outside, and is mounted and detached with respect to the image forming apparatus main body. Such a detachable body is, for example, a developing device unit having a shutter that opens and closes a flow-in port of the developer, a photoreceptor body unit having an opening and closing cover for protecting an opening portion of the photoreceptor that is exposed from outside light, a waste toner container having a shutter for opening and closing a flow-in port through which waste developer flows in, or a cleaning unit.

(H05) In the above-described example, it is preferable that the fin main body 13 is provided, but may be omitted.

(H06) In the above-described example, the coupling 16 for driving the bottle 1 is provided in the rear end. However, the exemplary embodiment of the invention is not limited to the configuration. For example, the configuration that a coupling shape is formed in the front end of the bottle 1 or a gear is formed on the outer peripheral surface of the bottle 1 and then the bottle 1 is rotated may be provided.

(H07) In the above-described example, the configuration that the toner seal 17 is disposed on the side of the rotation portions 1 and 11 and the convex portion 23*a* is disposed in the flange portion 21 is exemplified, but it is possible to replace the dispositions thereof each other.

(H08) In the above-described example, it is preferable that the small rib 46 is provided, but may be omitted.

(H09) In the above-described example, the configuration that the spacer rib 44 is provided in the flow-out portion 41 is exemplified. However, the exemplary embodiment of the invention is not limited to the configuration. For example, the spacer rib 44 may be configured to extend from the shutter main body 52 to the flow-out portion 41.

(H010) In the above-described example, it is preferable that the scraping film 59 is provided, but may be omitted.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A detachable body that is supported to be detachable from an image forming apparatus main body, the detachable body comprising:

an opening portion that connects an inside and an outside of the detachable body;

an opening and closing member that is movable between an open position and a closed position, wherein when the detachable body is mounted on the image forming apparatus main body, the opening and closing member is located at the open position to open the opening portion, when the detachable body is detached from the image forming apparatus main body, the opening and closing member is located at the closed position to close the opening portion, and the opening and closing member includes a lacing portion that faces the opening portion with a gap when the opening and closing member is located at the closed position;

a sealing member that is supported by the facing portion, wherein when the opening and closing member is moved to the open position, the sealing member has a thickness that is thicker than a gap between the opening portion and the facing portion, and when the opening and closing member is moved to the closed position, the sealing member elastically deforms to seal the opening portion;

a protrusion portion that protrudes from one of a frame portion around the opening portion and the facing portion toward the other of the frame portion and the facing portion, the protrusion portion having a protrusion amount shorter than the gap between the opening portion and the facing portion; and a scraping member that is supported by the facing portion, that scrapes the opening portion when the opening and closing member is moved from the open position to the closed position, and that includes a scraping portion extending to a position on an outside of an end portion of the opening and closing member, wherein the protrusion portion is disposed in a position corresponding to an outside of the scraping portion when the opening and closing member is located at the closed position, and the protrusion portion is configured to protect the scraping portion.

2. The detachable body according to claim 1, further comprising:

an accommodation portion that accommodates the developer therein, wherein the developer flows out from the accommodation portion through the opening portion.

3. An image forming apparatus comprising:

an image carrier;

a developing device that develops a latent image formed on a surface of the image carrier to a visible image; and the detachable body according to claim 1 wherein the developer to be replenished to the developing device flows out from the accommodation portion through the opening portion.

4. A detachable body that is supported to be detachable from an image forming apparatus main body, the detachable, body comprising:

an opening portion that connects an inside and an outside of the detachable body;

an opening and closing member that is movable between an open position and a closed position, wherein when the detachable body is mounted on the image forming apparatus main body, the opening and closing member is located at the open position to open the opening portion, when the detachable body is detached from the image forming apparatus main body, the opening and closing member is located at the closed position to close the opening portion, and the opening and closing member includes a facing portion that faces the opening portion with a gap when the opening and closing member is located at the closed position;

a sealing member that is supported by the facing portion, wherein when the opening and closing member is moved to the open position, the sealing member has a thickness that is thicker than a gap between the opening portion and the facing portion, and when the opening and closing member is moved to the closed position, the sealing member elastically deforms to seal the opening portion;

a first protrusion portion that protrudes from one of a frame portion around the opening portion and the facing portion toward the other of the frame portion and the facing portion, the first protrusion portion having a protrusion amount shorter than the gap between the opening portion and the facing portion;

a second protrusion portion that is formed in an edge of the opening portion that protrudes toward the facing portion, that has a protrusion amount shorter than that of the first protrusion portion, and that contacts with the sealing member when the opening and closing member is moved to the closed position; and a scraping member that is supported by the facing portion, that scrapes the opening portion when the opening and closing member is moved from the open position to the closed position, and that includes a scraping portion extending to a position on an outside of an end portion of the opening and closing member, wherein the first protrusion portion is disposed in a position corresponding to an outside of the scraping portion when the opening and closing member is located at the closed position.

5. The detachable body according to claim 4, further comprising:

an accommodation portion that accommodates the developer therein, wherein the developer flows out from the accommodation portion through the opening portion.

6. An image forming apparatus comprising:

an image carrier;

a developing device that develops a latent image formed on a surface of the image carrier to a visible image; and the detachable body according to claim 4 wherein the developer to be replenished to the developing device flows out from the accommodation portion through the opening portion.

* * * * *